US008695692B2

(12) United States Patent
Laing et al.

(10) Patent No.: US 8,695,692 B2
(45) Date of Patent: Apr. 15, 2014

(54) DOWNHOLE CONDITION ALERT SYSTEM FOR A DRILL OPERATOR

(75) Inventors: Moray L. Laing, Houston, TX (US); Andreas G. Sadlier, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/194,440

(22) Filed: Jul. 29, 2011

(65) Prior Publication Data

US 2013/0025851 A1 Jan. 31, 2013

(51) Int. Cl.
*E21B 43/00* (2006.01)

(52) U.S. Cl.
USPC ..... 166/66; 166/250.01; 175/40; 340/407.1

(58) Field of Classification Search
USPC ..... 166/250.01, 66; 175/40, 50; 340/407.1, 340/853.1, 853.2, 854.1, 856.3, 856.4, 679
See application file for complete search history.

(56) References Cited

U.S. PATENT DOCUMENTS

| | | | | |
|---|---|---|---|---|
| 5,273,122 | A | 12/1993 | Henneuse | |
| 6,515,592 | B1 | 2/2003 | Babour et al. | |
| 6,871,712 | B2 | 3/2005 | Koch et al. | |
| 7,334,839 | B1 * | 2/2008 | Malerba | 297/217.1 |
| 7,392,858 | B2 | 7/2008 | Koch | |
| 7,472,745 | B2 | 1/2009 | Lynde et al. | |
| 7,596,481 | B2 | 9/2009 | Zamora et al. | |
| 7,624,831 | B2 | 12/2009 | Orr | |
| 7,675,029 | B2 | 3/2010 | Ramstad et al. | |
| 7,730,967 | B2 | 6/2010 | Ballantyne et al. | |
| 7,841,414 | B1 | 11/2010 | Borgstadt | |
| 2002/0148644 | A1 | 10/2002 | Schultz et al. | |
| 2004/0044293 | A1 * | 3/2004 | Burton | 600/544 |
| 2005/0046565 | A1 * | 3/2005 | Hill | 340/531 |
| 2006/0020390 | A1 | 1/2006 | Miller | |
| 2006/0285436 | A1 | 12/2006 | Mayorga Lopez et al. | |
| 2007/0175633 | A1 | 8/2007 | Kosmala et al. | |
| 2007/0272404 | A1 | 11/2007 | Lynde et al. | |
| 2009/0205868 | A1 | 8/2009 | Lane | |
| 2010/0282461 | A1 | 11/2010 | Yee | |

OTHER PUBLICATIONS

G. Heisig et al., "Downhole Diagnosis of Drilling Dynamics Data Provides New Level Drilling Process Control to Driller", SPE Annual Technical Conference and Exhibition; Sep. 27-30, 1998, New Orleans, Louisiana, pp. 649-658.

International Search Report and Written Opinion; International Application No. PCT/US2012/048243; International Filing Date: Jul. 26, 2012; Date of Mailing: Jan. 17, 2013; 9 pages.

* cited by examiner

*Primary Examiner* — David Bagnell
*Assistant Examiner* — Taras P Bemko
(74) *Attorney, Agent, or Firm* — Cantor Colburn LLP

(57) ABSTRACT

An alert system for a downhole operation including a tubular string in a borehole. The tubular string having at least one sensor positioned in the borehole for measuring at least one parameter during operation of the tubular string. A unit in data communication with the tubular string and operatively arranged to enable an operator to obtain information regarding operation of the tubular string. A work area positioned proximate to the unit and operatively arranged to receive the operator when the operator is interfacing with the unit. A vibration module operatively arranged to vibrate the work area or a structure therein, wherein the vibration module is triggered in response to a first parameter being outside of a predetermined range set by a first threshold value. Also included is a method of alerting an operator during a drilling operation.

16 Claims, 2 Drawing Sheets

DOWNHOLE CONDITION ALERT SYSTEM FOR A DRILL OPERATOR

BACKGROUND

Previously in the downhole drilling industry, an operator had a mechanical connection to the drill string. This mechanical connection enabled the operator to "feel" problems occurring downhole based on behavior of the brake handle or other control mechanisms. For example, an operator may have been able to perceive conditions indicating that bit bounce, stick-slip, bit whirl, etc., was occurring and to take corrective measures to remedy any problems. With the advent of more advanced systems, this mechanical connection has been severed. While there are many benefits to remotely controlling a drilling operation, the operator has lost the ability to "feel" some potential problems downhole. The industry is accordingly desirous of advancements that improve an operator's ability to remotely control a drilling procedure.

BRIEF DESCRIPTION

An alert system for a downhole operation, includes a tubular string in a borehole, the tubular string having at least one sensor positioned in the borehole for measuring at least one parameter during operation of the tubular string; a unit in data communication with the tubular string and operatively arranged to enable an operator to obtain information regarding operation of the tubular string; a work area positioned proximate to the unit and operatively arranged to receive the operator when the operator is interfacing with the unit; and a vibration module operatively arranged to vibrate the work area or a structure therein, wherein the vibration module is triggered in response to a first parameter being outside of a predetermined range set by a first threshold value.

A method of alerting an operator during a drilling operation includes measuring at least one parameter of operation of the tubular string with at least one sensor while performing a downhole operation with the tubular string; determining if the at least one parameter is in a predetermined range based on at least one threshold value; and vibrating a work area or a structure therein with a vibration module in response to the at least one parameter being outside of the predetermined range, the work area located proximate to a unit operatively arranged for enabling an operator to obtain information regarding operation of the tubular string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
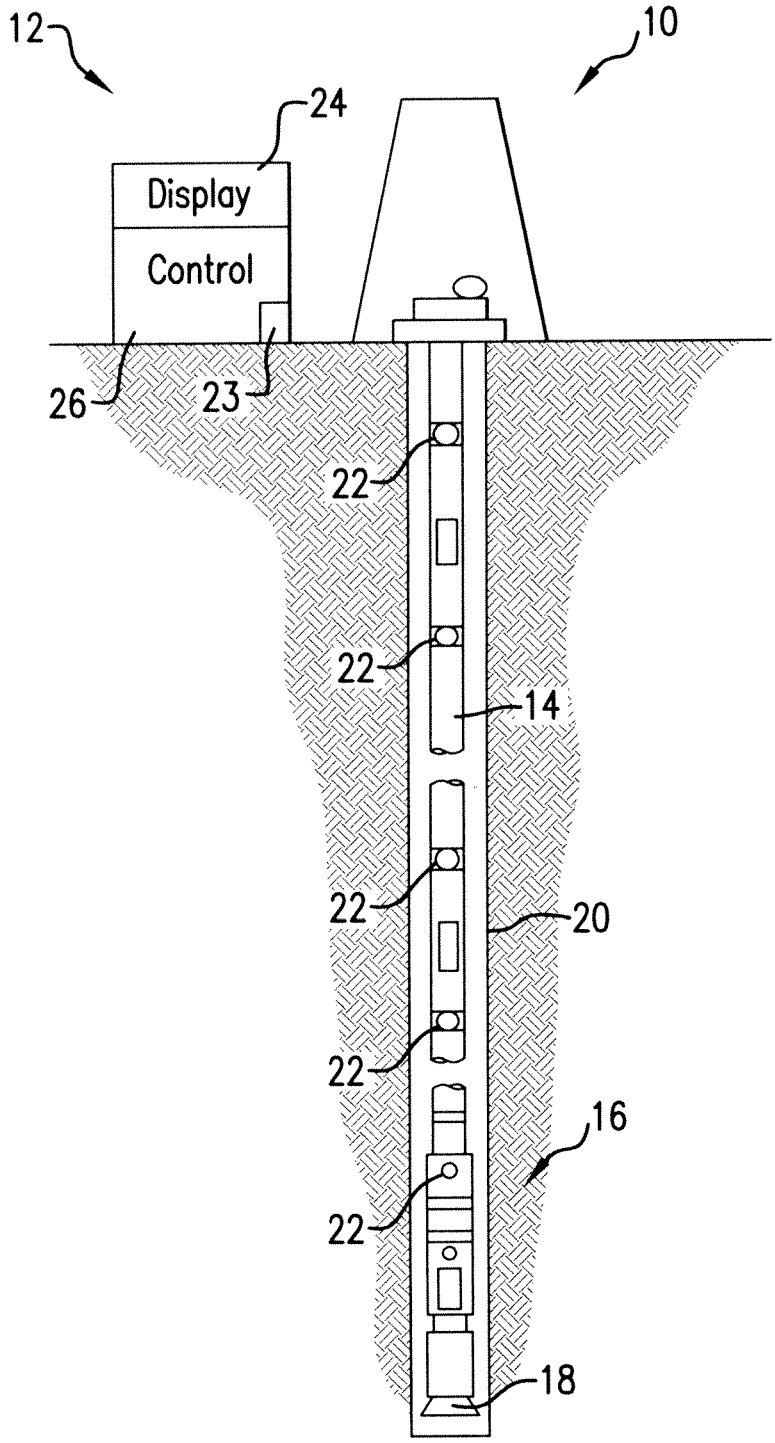
FIG. 1 is a schematic view of a system for drilling a borehole.

Referring now to FIG. 1, a drilling system 10 is shown. The system 10 includes a control unit 12 for enabling an operator to control operation of a drill string 14. The drill string 14 terminates in a bottom hole assembly (BHA) 16 having a drill bit 18 for forming a borehole 20. By "operator" it is meant any person, user, worker, employee, driller, etc. who controls the system 10 for drilling the borehole 20 or desires or requires access to information concerning another downhole activity. The control unit 12 could be located in a trailer or the like proximate the borehole 20. The control unit 12 is arranged to remotely control the operation of the drill string 14 via known means. For example, U.S. Pat. No. 7,730,967 (Ballantyne et al.) discloses a borehole drilling system, which Patent is hereby incorporated by reference in its entirety.

The drill string 14 also includes a plurality of sensors 22 along its length. For example, the sensors 22 can measure: borehole pressure and temperature; drilling parameters, such as weight on bit, rotational speed of the drill bit and/or the drill string, the drilling fluid flow rate, etc.; bottomhole assembly conditions or parameters, such as mud motor differential pressure, torque, bit bounce and whirl, etc.; and any other conditions or parameters desired to be known (hereinafter, generally "parameters"). Exemplary sensors include temperature gages, strain gages, accelerometers, pressure transducers, magnetometers, electrical field strength sensors and other sensors known to one skilled in the art. For example, a plurality of accelerometers could be arranged to detect movement of the drill string 14 or a component or portion thereof along the X, Y, and Z axes (see FIG. 3) or to sense other parameters indicative of downhole problems. These detected movements and other parameters could be compared, for example, to predetermined maximum and/or minimum threshold values for setting a predetermined range of acceptable values. A computer processor 23 or logic unit in the control unit 12, in a sub of the drill string 14, etc., could be arranged to perform the comparison with the threshold values, which values could be stored in any suitable form of memory or data storage. Problems such as bit bounce (i.e., axial movement of the drill string 14), bit whirl (i.e., lateral movement of the drill string 14), stick-slip (i.e., torque in the drill string 14), etc. are therefore detectable by the sensors 22 and processor 23.

Figure 2:
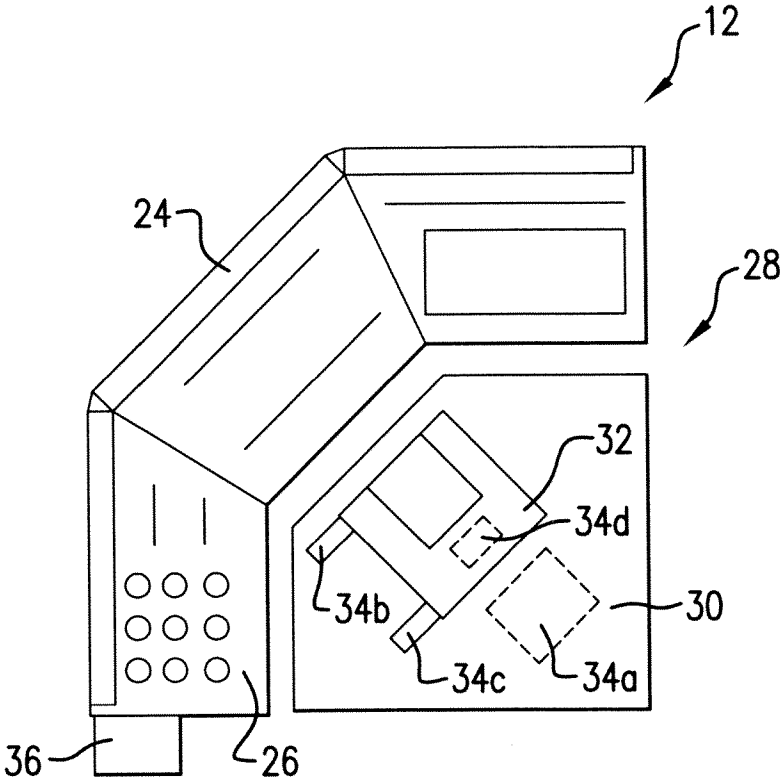
FIG. 2 is a schematic top view of a control unit for an operator to remotely control a drilling operation.

One embodiment of the control unit 12 is shown schematically in FIG. 2. The control unit 12 enables control of drilling operation and includes, for example, a display device 24, a console 26, and a work area 28 positioned near the display device 24 and/or console 26. The display device 24 comprises, for example, a monitor, electronic display panel, etc. The display 24 provides the operator with information relating to drilling in various formats, e.g., pictorial, numeric, alphanumeric, etc. The console 26 includes various communication, input and/or interfacing devices for enabling the operator to communicate with the control unit 12, e.g., a mouse, keyboard, keypad, joystick, etc. The work area 28 is arranged for receiving the operator when the operator is controlling, operating, or otherwise interfacing with the control unit 12. For example, it may take the form of a portion, panel, plate, or section of flooring on which the operator stands to control the control unit 12, a seat or chair in which the operator sits while controlling the control unit 12, etc. In other words, the work area 28 is the component or structure on which the operator is physically located in order to operate the control unit 12. For example, a floor section 30 and a seat 32 are shown in FIG. 2 located in an area convenient for viewing, manipulating, and/or otherwise interfacing with the displays 24 and console 26. Other related components and equipment of the unit 12 are well known in the art and are not described in detail herein.

While many benefits are achievable with current remotely controlled systems, the lack of a mechanical connection between the driller and the downhole equipment inherently removes one means in which the driller's used to sense potential problems downhole, i.e., through vibrations and the like in the drilling controls. In order to alert the operator of undesired or unsatisfactory downhole conditions, e.g., stick-slip, bit bounce, bit whirl, etc., one or more vibration modules are included in the work area 28. In FIG. 2, vibration modules 34*a*, 34*b*, 34*c*, and 34*d* are shown (collectively, the "vibrations modules 34") for introducing vibrations, oscillations, or other detectable movements into the work area 28 for alerting the operator of a potential downhole problem or issue that requires correction. For example, the vibration modules may take any form for inducing movement, such as motorized cam shafts or unbalanced shafts, actuatable pistons or plungers, opposing electromagnets, etc. In one embodiment, the vibration modules 34 are arranged in data communication with the control unit 12, the sensors 22, and/or the processor 23 and triggered in response to one of the parameters measured by the sensors 22 exceeding or dropping below its corresponding threshold value.

Figure 3:
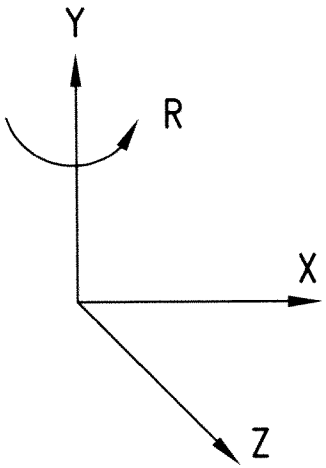
FIG. 3 shows a set of reference axes.

With respect to the axes of FIG. 3, for example, undesirably high movement sensed by the sensors 22 in the X, Y, and Z directions, along with rotational movement (torque) R, can be communicated uniquely via ones of the vibration modules 34 to the operator. For example, the vibration module 34*a* is arranged to vibrate the flooring section 30 in the work area 28. Since the operator must be positioned in the work area 28 in order to interface with the control unit 12, vibrations in the floor section 30 will be felt by the operation, regardless of if the operator is standing or sitting on a seat, e.g., the seat 32, located in the work area 28.

The vibration modules 34*b*, 34*c*, and 34*d* are arranged to vibrate the seat 32 instead of the floor general and can be configured to vibrate the seat differently in response to various downhole events or conditions. For example, in the event that stick-slip is detected (e.g., rotational movement or torque, R in FIG. 3, exceeds its threshold value) one of the vibrations modules 34*a* or 34*b* could be triggered to cause vibrations to correspondingly rotate the seat 32. That is, by arranging the vibration modules 34*b* or 34*c* off-center with respect to the seat 32, triggering only one of these modules will introduce vibrations that slightly rotate the seat 32. This rotation of the seat 32 would indicate to the operator that impermissibly high rotation, torque, or stick-slip, is detected in the drill string 14. Similarly, arranging the vibration module 34*d* under the seat to cause the seat 32 to rock back and forth due to its vibrations could be used to indicate that impermissibly high axial movement, or bit bounce, is detected. Triggering both modules 34*b* and 34*c* simultaneously would rock the seat 32 side to side and could indicate unacceptably high lateral movement of the drill string 14, i.e., bit whirl. In this way, different forms of vibrations could be used to indicate different downhole problems, where the different vibrations mimic, imitate, relate to, correspond to, describe, or otherwise represent the condition occurring downhole. This enables the operator to immediately and intuitively recognize a variety of issues occurring downhole without having to focus attention on a display screen, interpret data, etc.

The strength and frequency of the vibrations should be set so that they do not interfere with the operator's ability to work, but also so that they are not easily missed or ignored. They could also be tuned for the operator's weight, preferences, sensibility, etc. When the operator has taken appropriate action to relieve the undesirable downhole condition, the vibration modules would be signaled to cease vibrating. The vibrations can be set to cause some degree of annoyance to the operator, such that the operator is provided with even further motivation to quickly take remedial actions in order to avoid damage to the drill string 14, the BHA 16, the bit 18, etc.

In one embodiment, visual signals accompany the vibrations and are used to indicate to the operator that the system is operating outside of the predetermined norms, e.g., one of the parameters has exceeded or dropped below its corresponding threshold value. For instance, some portion of the display 24 could be shown in first color (e.g., yellow) for operation approaching the threshold value and with a second color (e.g., red) for operation outside of threshold value. In another example, the console 26, the work area 28, etc. could be illuminated by lights of these first and second colors. In another example, the colors or illumination could pulse or flash on and off, between two colors, etc. so that they are readily recognized and not easily missed or ignored.

In one embodiment, the control unit 12 additionally includes one or more audio devices 36 for playing a sound, series of sounds, sound bite, etc. in response to one of the downhole parameters exceeding its corresponding predetermined threshold value. Similar to some examples for the vibration modules 34 given above, a sound or series of sounds could be selected representative of or corresponding to potential issues downhole. That is, the sounds themselves would be selected such that they mimic, sound-like, define, or otherwise inherently represent the detected downhole problems. For example, a whirring noise could play for bit whirl, a knocking or jackhammering noise for bit bounce, etc. Thus, the operator would not just be hearing a generic alarm, but would instead hear sounds representative of the actual problem that needs to be rectified. Again, this reduces the operators need to focus attention on a display, interpret information, etc., as the association between the sound played and the problem would be intuitive. The audio device 36 could take the form of, or be incorporated into, a loud speaker, a headset, headphones, a speaker in data communication with the control unit 12, etc.

Accordingly, a combination of the above embodiments would enable an operator to be informed of possible problems by use of three of the operator's primary senses. Further, the alert signals can be tailored to represent the actual events that are occurring so that the operator intuitively appreciates the problem without having to focus on a screen or display, interpret data, etc. In one embodiment, for example, a plurality of different conditions are uniquely communicated to the operator via a different one of the operator's senses, e.g., stick-slip by visual color changing, bit whirl by playing a whirring sound, and bit bounce by vibrations.

In addition to the foregoing, it is to be appreciated that the alert features of the current invention are applicable to any other downhole operation, such as circulation, tripping, reaming, etc. and that any appropriate tubular string could be utilized. Furthermore, the alerts as described above, whether vibratory, audible, and/or visual, could be transmitted according to the above embodiments to multiple locations, people, etc. simultaneously. For example, in some embodiments the feedback or alerts would be communicated to personnel who only monitor and do not control the downhole operations (as noted above, monitoring personnel and others also generally referred to herein as operators for ease of discussion).

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. An alert system for a downhole operation, comprising:

a drill string in a borehole, the drill string having at least one sensor positioned in the borehole for measuring one or more parameters during a drilling operation of the drill string, the one or more parameters related to movement of the drill string in one or more selected directions relative to the borehole during the drilling operation;

a unit in data communication with the drill string and operatively arranged to enable an operator to obtain information regarding the drilling operation of the drill string;

a work area positioned proximate to the unit and including a seat operatively arranged to receive the operator when the operator is interfacing with the unit; and a module operatively arranged to move the seat in a first heading corresponding to a first selected direction of the one or more selected directions in response to the one or more parameters being outside of a first predetermined range set by a first threshold value and in a second heading corresponding to a second selected direction of the one or more selected directions in response to the one or more parameters being outside of a second predetermined range set by a second threshold value, wherein the first heading is different than the second heading and the first selected direction is different than the second selected direction.

2. The system of claim 1, wherein when the first selected direction is axial, the one or more parameters indicate bit bounce, and the module is operatively arranged to rock the seat forward and back.

3. The system of claim 1, wherein when the first selected direction is lateral, the one or more parameters indicate bit whirl, and the module is operatively arranged to rock the seat side to side.

4. The system of claim 1, wherein when the first selected direction is rotational, the one or more parameters indicate stick-slip, and the module is operatively arranged to rotate the seat back and forth.

5. The system of claim 1, further comprising a processor in data communication with the at least one sensor and the module, the processor comparing a sensed value of the one or more parameters to the first threshold value for determining when the one or more parameters have gone outside the first predetermined range and to the second threshold value for determining when the one or more parameters have gone outside the second predetermined range.

6. The system of claim 1, wherein the unit includes a display for displaying information pertaining to the drill string, the at least one sensor, the one or more parameters, or combinations including at least one of the foregoing.

7. The system of claim 6, wherein the display is operatively arranged to normally display a first color and to transition to displaying a second color upon the one or more parameters being outside either the first or second predetermined ranges.

8. The system of claim 1, further comprising an audio device for playing a sound in response to the one or more parameters being outside either the first or second predetermined ranges.

9. The system of claim 8, wherein the sound imitates a condition corresponding to movement of the drill string in the first or second selected directions.

10. The system of claim 1, wherein the one or more parameters include a first parameter that relates to the first selected direction and a first downhole condition, the one or more parameters include a second parameter that relates to the second selected direction and a second downhole condition, and the one or more parameters include a third parameter that relates to a third downhole condition and a third heading in which the module moves the seat in response to the third parameter being outside of a third predetermined range set by a third threshold value.

11. The system of claim 10, wherein the first downhole condition is bit bounce, the second downhole condition is bit whirl, and the third downhole condition is stick-slip.

12. A method of alerting an operator during a drilling operation comprising:

measuring one or more parameters of operation of the drill string with at least one sensor while performing a downhole operation with the drill string, the one or more parameters related to movement of the drill string in one or more selected directions with respect to the borehole during the drilling operation;

determining if the one or more parameters are in a first predetermined range set by a first threshold value;

determining if the one or more parameters are in a second predetermined range set by a second threshold value; and moving a seat with a module in a first heading corresponding to a first selected direction of the one or more selected directions in response to the one or more parameters being outside of the first predetermined range, or in a second heading corresponding to a second selected direction of the one or more selected directions in response to the one or more parameters being outside of the second predetermined range, the first selected direction being different than the second selected direction and the first heading being different than the second heading, the seat operatively arranged to receive an operator and located proximate to a unit operatively arranged for enabling the operator to obtain information regarding operation of the drill string.

13. The method of claim 12, wherein the determining is performed by a processor in data communication with the at least one sensor.

14. The method of claim 12, wherein moving the seat includes rocking the seat forward and back when the first or second selected direction is axial and the one or more parameters indicate bit bounce.

15. The method of claim 12, wherein moving the seat includes rocking the seat side to side when the first or second selected direction is lateral and the one or more parameters indicate bit whirl.

16. The method of claim 12, wherein moving the seat includes rotating the seat when the first or second selected direction is rotational and the one or more parameters indicate stick slip.

* * * * *